US007101271B2

(12) United States Patent
Moon

(10) Patent No.: US 7,101,271 B2
(45) Date of Patent: Sep. 5, 2006

(54) POLISHING HEAD AND CHEMICAL MECHANICAL POLISHING APPARATUS

(75) Inventor: Jin-Ok Moon, Gyeonggi-Do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 87 days.

(21) Appl. No.: 10/739,193

(22) Filed: Dec. 19, 2003

(65) Prior Publication Data

US 2004/0137832 A1 Jul. 15, 2004

(30) Foreign Application Priority Data

Jan. 14, 2003 (KR) ..... 10-2003-0002468

(51) Int. Cl.

| | |
|---|---|
| ***B24B 5/00*** | (2006.01) |
| ***B24B 7/00*** | (2006.01) |
| ***B24B 41/06*** | (2006.01) |
| *B24B 1/00* | (2006.01) |

(52) U.S. Cl. ..... 451/285; 451/288; 451/397; 451/402

(58) Field of Classification Search ..... 451/285–290, 451/397, 402, 390

See application file for complete search history.

(56) References Cited

U.S. PATENT DOCUMENTS

| | | | | |
|---|---|---|---|---|
| 5,423,716 | A | 6/1995 | Strasbaugh | |
| 6,210,255 | B1 | 4/2001 | Zuniga et al. | |
| 6,290,584 | B1 * | 9/2001 | Kim et al. | 451/288 |
| 6,361,419 | B1 | 3/2002 | Zuniga et al. | |
| 6,746,318 | B1 * | 6/2004 | Mallery et al. | 451/285 |
| 6,746,565 | B1 * | 6/2004 | Bleck et al. | 156/345.14 |
| 6,755,726 | B1 * | 6/2004 | Chen et al. | 451/398 |
| 6,857,931 | B1 * | 2/2005 | Chen et al. | 450/8 |
| 2002/0077051 | A1 * | 6/2002 | Keller | 451/398 |
| 2002/0182996 | A1 * | 12/2002 | Zuniga et al. | 451/401 |

* cited by examiner

*Primary Examiner*—M. Rachuba
(74) *Attorney, Agent, or Firm*—Volentine Francos & Whitt, PLLC

(57) ABSTRACT

An apparatus for polishing chemically and mechanically a wafer includes a membrane supporter and a membrane. The membrane has a pressure portion that is divided into a plurality of regions, and a partition portion extending from the border between the plurality regions. The partition portion of the membrane is fixed to a slider that can move up and down in a guide groove formed in the membrane supporter.

19 Claims, 8 Drawing Sheets

POLISHING HEAD AND CHEMICAL MECHANICAL POLISHING APPARATUS

BACKGROUND OF THE INVENTION

1. Field of the Invention

The present invention relates generally to a chemical mechanical polishing apparatus. More particularly, the present invention relates to the polishing head of a chemical mechanical polishing apparatus.

2. Description of the Related Art

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the surface of the wafer becomes increasingly non-planar. This non-planar surface presents problems in the photolithographic steps of the integrated circuit fabrication process. Therefore, there is a need to periodically planarize the wafer surface.

Chemical mechanical polishing (CMP) is a typical process used for this purpose. The CMP process is well-suited for use in connection with large-diameter wafers because the CMP process produces excellent uniformity in planarizing wide areas in addition to narrow ones.

The CMP process makes use of mechanical friction and a chemical agent for finely polishing a wafer surface. In the mechanical aspect of such polishing, a wafer is placed on a rotating polishing pad and is rotated while a predetermined load is applied thereto, whereby the wafer surface is polished by the friction created between the polishing pad and the wafer surface. In the chemical aspect of such polishing, the wafer surface is polished by a chemical polishing agent, referred to as slurry, supplied between the polishing pad and the wafer.

Typical CMP apparatus are disclosed in U.S. Pat. Nos. 5,423,716, 6,210,255, and 6,361,419. In these CMP apparatus, a wafer is held by a polishing head with the surface of the wafer to be polished (the process surface or polishing surface) facing a polishing pad. Then the wafer surface to be polished is placed against the polishing pad. At this time, the polishing head exerts a controllable pressure at the rear surface of the wafer.

More specifically, the polishing head includes a flexible membrane that provides a mounting surface to which the wafer is adhered, and a retaining ring to prevent the wafer adhered to the membrane from leaving the polishing head. The polishing head also includes a chamber and, and air inlets leading into the chamber. The membrane is expanded by feeding air into the chamber via the inlets. Thus, the load on the wafer is controlled by the amount of air fed into the chamber of the polishing head. Frequently, it is necessary to exert pressure on the wafer that varies from region to region across the wafer. To this end, a plurality of chambers may be formed in the polishing head and the membrane may include a fixing portion that extends upwards from the border between adjacent regions of the wafer and is fixed in a membrane supporter. The portions of the membrane corresponding to the various regions of the wafer are expanded when air is supplied into each of the chambers. However, a portion of the membrane corresponding to the border between the regions of the wafer, i.e., the portion of the membrane fixed to the membrane supporter, is not expanded. Accordingly, the lower surface of this portion of the membrane forms a concavity that prevents the CMP process from polishing the wafer with a high degree of uniformity.

SUMMARY OF THE INVENTION

An object of the present invention is to provide a polishing head of a chemical mechanical polishing apparatus that can polish a wafer with high degrees of uniformity in each of a plurality of different regions.

An apparatus for polishing a wafer, according to the present invention, includes a platen, a polishing pad that adheres to the platen, and a polishing head assembly by which the wafer is pressed against the polishing pad. The polishing head of the assembly has a membrane supporter and a membrane fixed to the membrane supporter. The membrane has a pressure portion including a plurality of regions that can be basically independently expanded and contracted, and a partition portion extending upwards from the border between the regions of the pressure portion. The partition portion is fixed to a slider that is received in a guide groove in the membrane supporter. When the membrane is expanded or contracted, the slider moves vertically in the guide groove.

The bottom surface of the slider is located in the guide groove or on the same plane as the open lower end of the guide groove when the membrane is contracted. Also, the bottom surface of the slider is spaced from the pressure portion of the membrane.

The slider may be longer than the distance between the pressure portion of the membrane and the membrane supporter when the membrane is expanded to the maximum extent possible. Accordingly, the slider will not come out of the guide groove during operation.

Also, a buffer may be interposed between the slider and an inner wall of the membrane supporter that defines the guide groove to facilitate the movement of the slider in the guide groove. The buffer may be a discrete member formed from a tetrafluoroethylene fluorocarbon compound, such as polytetrafluoroethylene (PTFE), (e.g., Teflon™), or may be a discrete member merely coated with a lubricant.

DETAILED DESCRIPTION OF THE PREFERRED EMBODIMENTS

Figure 1:
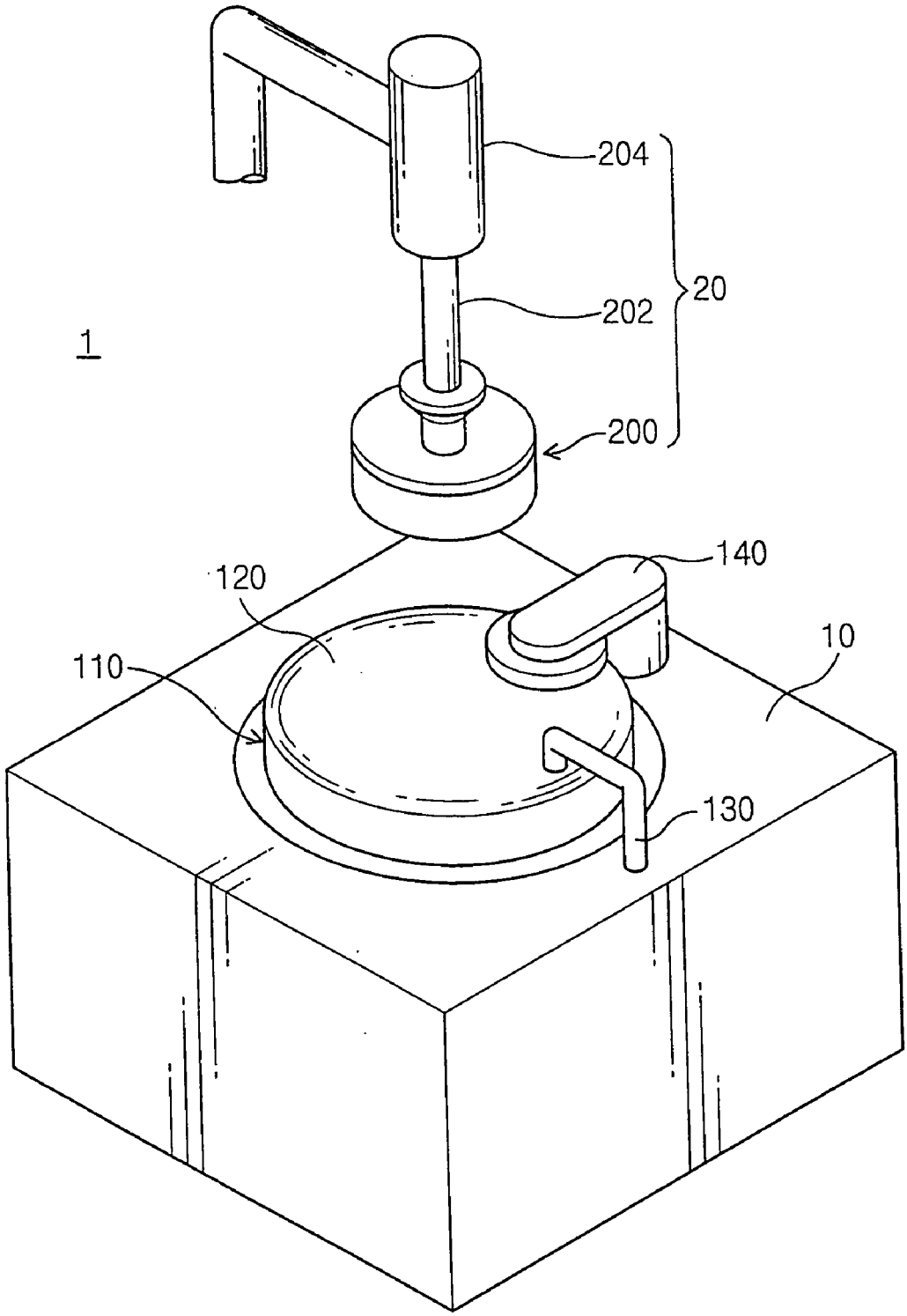
FIG. 1 is a perspective view of a chemical mechanical polishing apparatus according to the present invention.

Referring to FIG. 1, the chemical mechanical polishing apparatus 1 includes a base 10, a platen 110, a polishing pad 120, a pad conditioner 140, a slurry supply arm 130, and a polishing head assembly 20.

The polishing pad 120 is generally a flat disc of material having a rough surface and directly contacts the wafer to thereby mechanically polish the wafer. The polishing pad 120 adheres to the platen 110 and is rotated with the platen 110 during the polishing process. A driving motor (not shown) may be installed in the base 10 for rotating the platen 110 at an appropriate speed. The pad conditioner 140 and the slurry supply arm 130 may be provided at the side of the polishing pad 120. The pad conditioner 140 maintains the surface state (polishing condition) of the polishing pad 120 and the slurry supply arm 130 supplies slurry onto a surface of the polishing pad 120

The polishing head assembly 20 is located above the polishing pad 120. The polishing head assembly 20 has a polishing head 200, a driving shaft 202, and a driving motor 204. The polishing head 200 secures a wafer, thereby fixing it and exerts a controllable force against a rear side of the wafer in order to press the wafer against the polishing pad 120. The driving shaft 202 is connected to the upper part of the polishing head 200, and the driving motor 204 rotates the driving shaft 202 with the polishing head 200.

Figure 2:
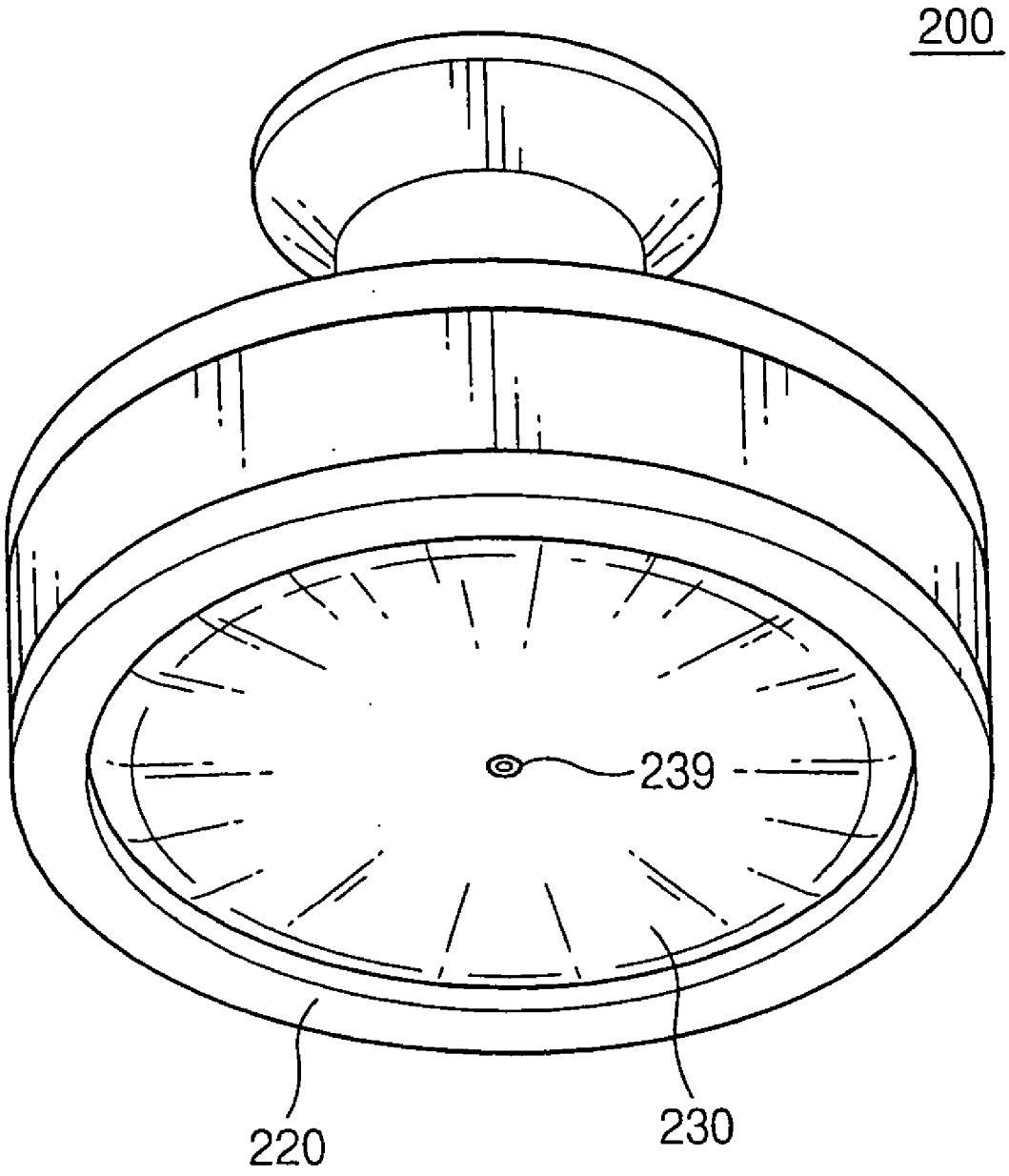
FIG. 2 is a perspective view of the polishing head of the apparatus shown in FIG. 1.
Figure 3:
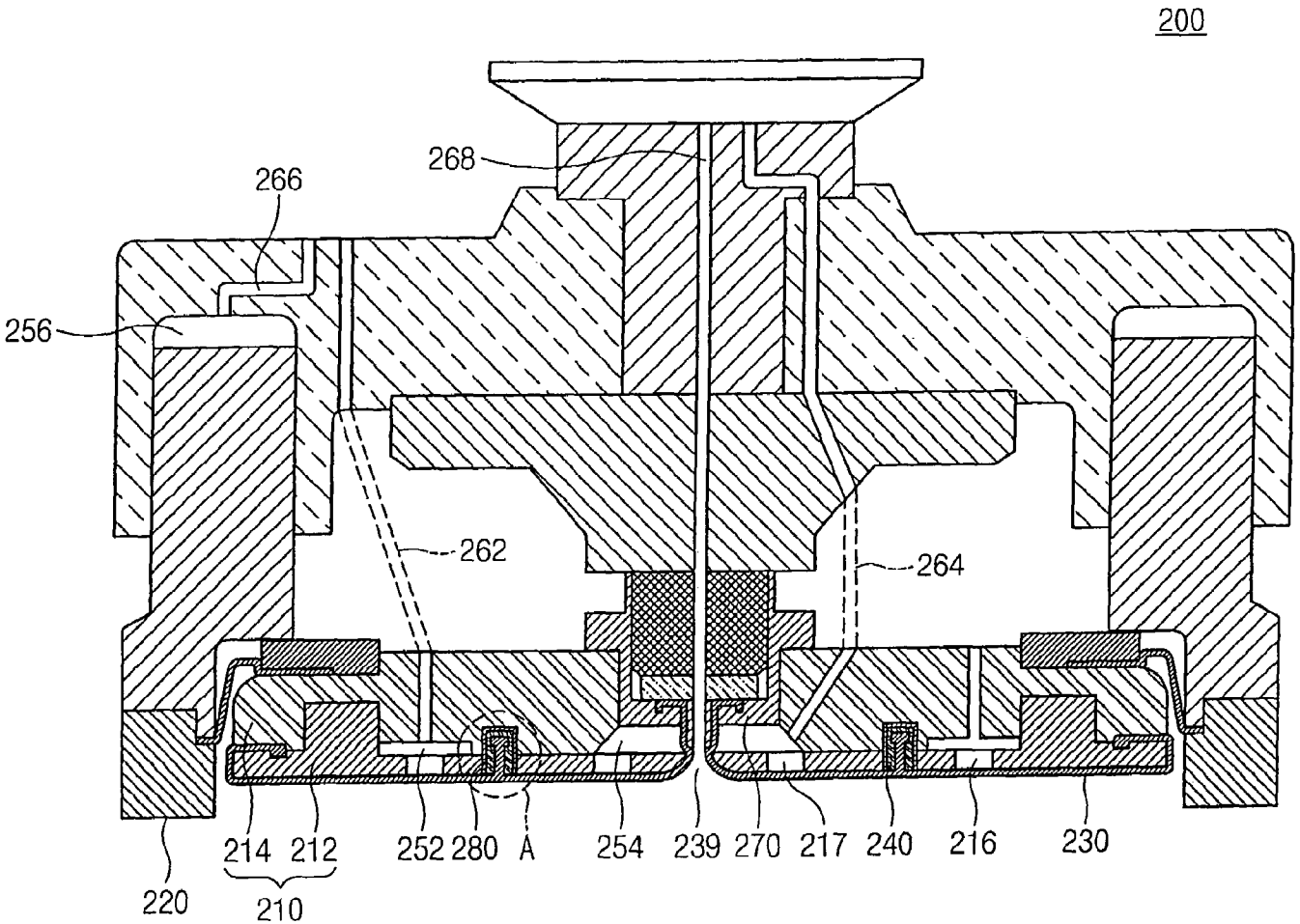
FIG. 3 is a sectional view of the polishing head shown in FIG. 2.

Referring now to FIG. 2 and FIG. 3, the polishing head 200 has a membrane supporter 210, a retainer ring 220, a membrane 230, and a slider ring 240.

The membrane supporter 210 includes a supporting plate 212 and a clamp ring 214 for supporting the membrane 230. The clamp ring 214 is mounted to a gimbal 270. A space that is surrounded by the supporting plate 212 and the clamp ring 214 is formed in the polishing head 200. The space constitutes a first chamber 252. Air for exerting pressuring on the outer peripheral portion of the membrane 230 is supplied into the first chamber 252 via a first fluid supply line 262 formed in the polishing head. On the other hand, the supporting plate 212, the clamp ring 214 and the gimbal 270 delimit a second space that constitutes a second chamber 254. Air for exerting pressure at a central portion of the membrane 230 is supplied into the second chamber 254 via a second fluid supply line 264 formed in the polishing head.

The first fluid supply line 262 and the second fluid supply line 264 are respectively connected to a vacuum pump (not shown). First holes 216 and second holes 217 are formed in the supporting plate 212. The first holes 216 are formed below the first chamber 252 and the second holes 217 are formed below the second chamber 254. Air that is introduced into the first chamber 252 flows through the first holes 216, thereby exerting pressure on the outer peripheral edge of the membrane 230 to expand the outer peripheral edge of the membrane 230. Air that is introduced into the second chamber 254 flows through the second holes 217, thereby exerting pressure on the center of the membrane 230 and expanding the central portion of the membrane 230. The amounts of air that are introduced into the first chamber 252 and the second chamber 254 may be respectively controlled. A guide groove 290 (see FIG. 7A) that receives the slider ring 240 is formed in the supporting plate 212 between the first hole 216 and the second hole 217 of the supporting plate 212. The guide groove 290 may be formed in the supporting plate 212 only or may be formed in both the supporting plate 212 and the clamp ring 214.

The retainer ring 220 is disposed around the supporting plate 212 and the membrane 230. The retainer ring 220 prevents the wafer adhered to the membrane 230 from leaving from the polishing head 200. A third chamber 256 is formed above the retainer ring 220 in the polishing head 200, and a third fluid supply line 266 is connected to the third chamber 256. Pressure is exerted on the retainer ring 220 by air that is introduced into the third chamber 256.

Figure 4:
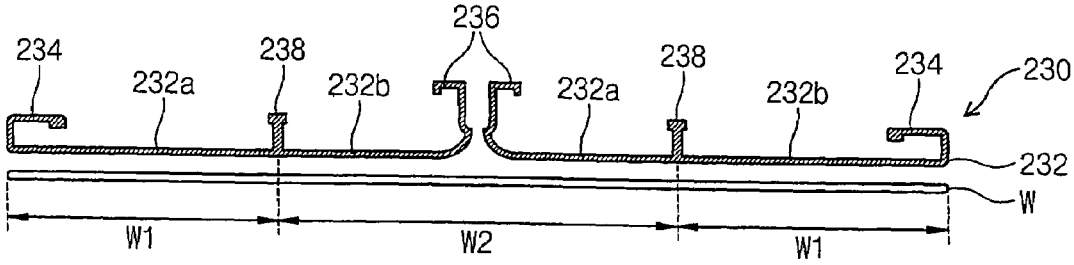
FIG. 4 is a sectional view of a membrane of the polishing head and of a wafer.

The membrane 230 is a circular thin rubber film and both secures and exerts pressure on the wafer W. Referring to FIG. 4, the membrane 230 has a pressure portion 232, a first fixing portion 234, a second fixing portion 236, and a partition portion 238.

The pressure portion 232 of the membrane 230 is located below the supporting plate 212 and exerts the pressure against the rear surface of the wafer W. The pressure portion 232 of the membrane 230 is divided into a first region 232*a* and a second region 232*b*. The first region 232*a* is an outer peripheral portion of the membrane 230 and is expanded by the air that is introduced into the first chamber 252, thereby exerting pressure on a corresponding outer peripheral edge portion of the wafer W1. The second region 232*b* is a central portion of the membrane 230 and is expanded by the air that is introduced into the second chamber 254, thereby exerting pressure on a corresponding central portion of the wafer W2.

The first fixing portion 234 of the membrane 230 fixes the membrane 230 to the supporting plate 212. The first fixing portion 234 extends upwards from the outer circumference of the pressuring portion 232 and covers the side and part of the upper surface of the supporting plate 212. The first fixing portion 234 is fixed by the clamp ring 214, which is located on the supporting plate 212. The second fixing portion 236 extends upwards from the center of the pressuring portion 232 and is fixed by the gimbal 270. A vacuum hole 239 is formed in the center of the membrane 230. A vacuum line 268 formed in the polishing head 200 communicates with the vacuum hole 239 in the center of the membrane 230. A vacuum pump (not shown) is connected to the vacuum line 268. Accordingly, a wafer W is adhered to the membrane 230 by suction created by the vacuum pump as exerted on the wafer W via the vacuum line 268 and the vacuum hole 239.

The partition portion 238 of the membrane 230 divides the pressure portion 232 into the first region 232*a* and the second region 232*b*. The partition portion 238 extends upwards from the border between the first region 232*a* and the second region 232*b* of the pressure portion 232 and is fixed to the slider ring 240. The slider ring 240 is received in the guide groove 290 and moves up and down therein when the membrane 230 is expanded and contracted.

Figure 5A:
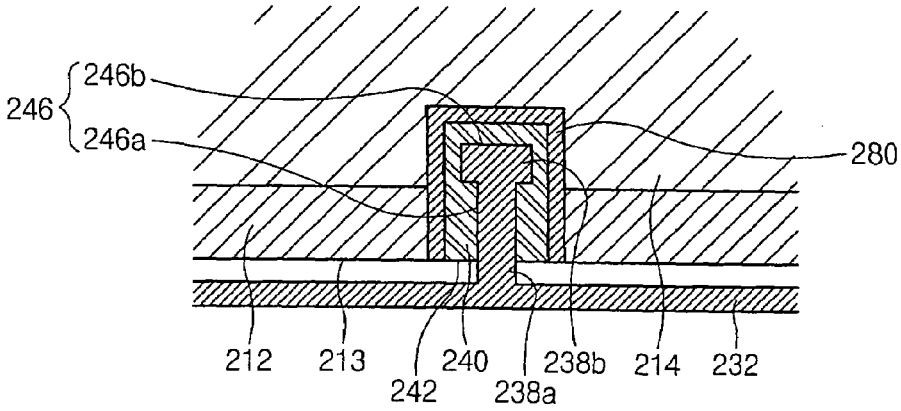
FIG. 5A is an enlarged sectional view of portion A of the polishing head of FIG. 3, showing a fixing partition part of the membrane in a slider ring.
Figure 5B:
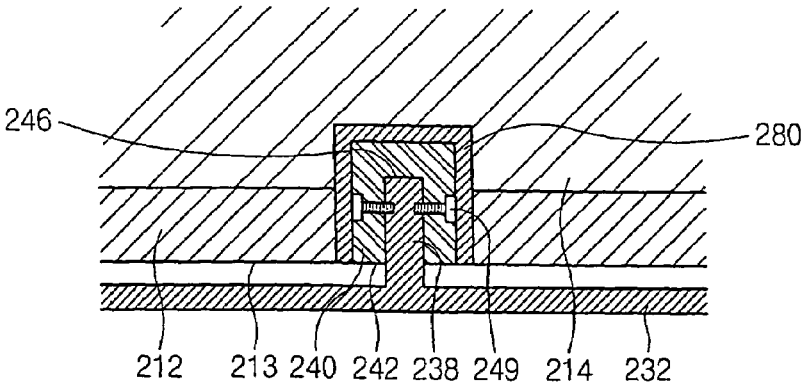
FIG. 5B is similar enlarged sectional view, but showing another type of fixing partition part of the membrane in a slider ring.

Referring to FIG. 5*a*, the slider ring 240 has a groove 246 for receiving the partition portion 238 of the membrane 230. The groove 246 comprises a lower portion 246*a* and an upper portion 246*b*. The upper portion 246*b* extends upwards from the lower portion 246*a* and has a cross section that is wider than that of the lower portion 246*a*. The partition portion 238 of the membrane 230 comprises a lower portion 238*a* and an upper portion 238*b* corresponding to the lower portion 246*a* and the upper portion 246*b* of the groove 246. The upper portion 238*b* of the partition portion 238 is received in the upper portion 246*b* of the groove 246, whereby the partition portion 246 Of the membrane 230 is firmly fixed to the slider ring 240. Referring to the FIG. 5*b*, the groove 246 of the slider ring 240 and the partition portion 238 of the membrane 230 may each have a linear form. In this case, the partition portion 238 of the membrane 230 is fixed to the slider ring 240 by fixing pins 249. The slider ring 240 may be made of stainless steel but preferably the slider ring 240 is made of Teflon™ to save weight.

The bottom surface 242 of the slider ring 240 is spaced from the pressure portion 232 of the membrane 230. Also, the bottom surface 242 of the slider ring 240 is located on the same plane as the open lower end of the guide groove 290. This prevents the pressure portion 232 of the membrane 230 from being scratched by the slider ring 240 when the membrane 230 is contracted.

Figure 6A:
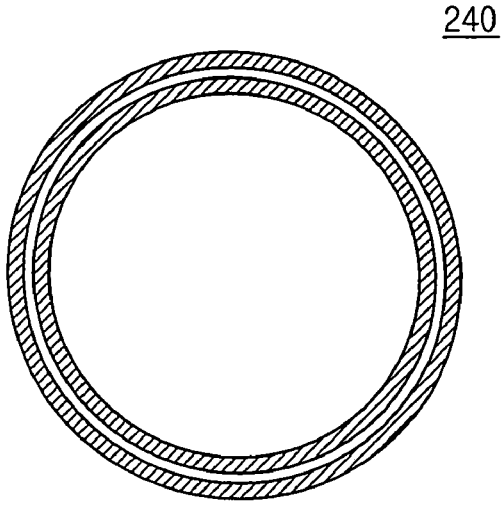
FIGS. 6A, 6B, 6C and 6D are each a cross-sectional view of a respective slider ring.
Figure 6B:
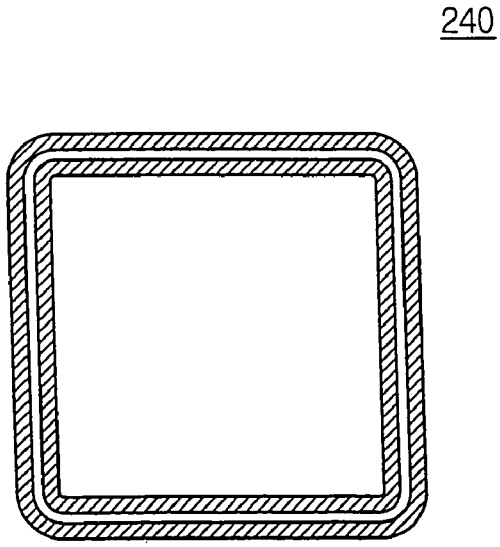
Figure 6C:
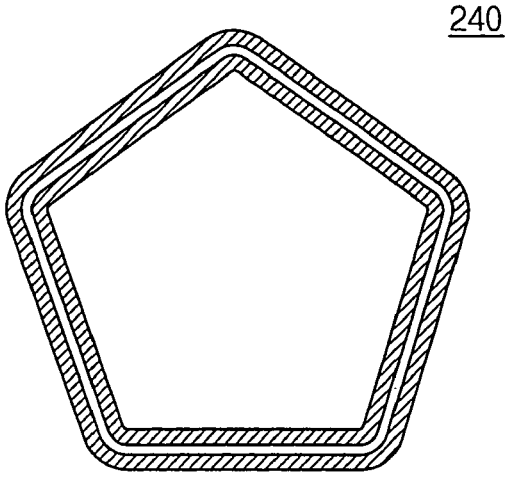
Figure 6D:
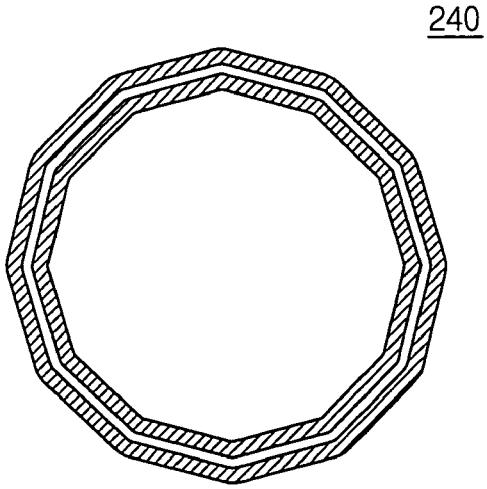

The cross section of the slider ring 240 may be circular, as shown in FIG. 6*a*, or may be that of a regular polygon having rounded corners, as shown in FIG. 6*b*, 6*c*, and 6*d*.

Figure 7A:
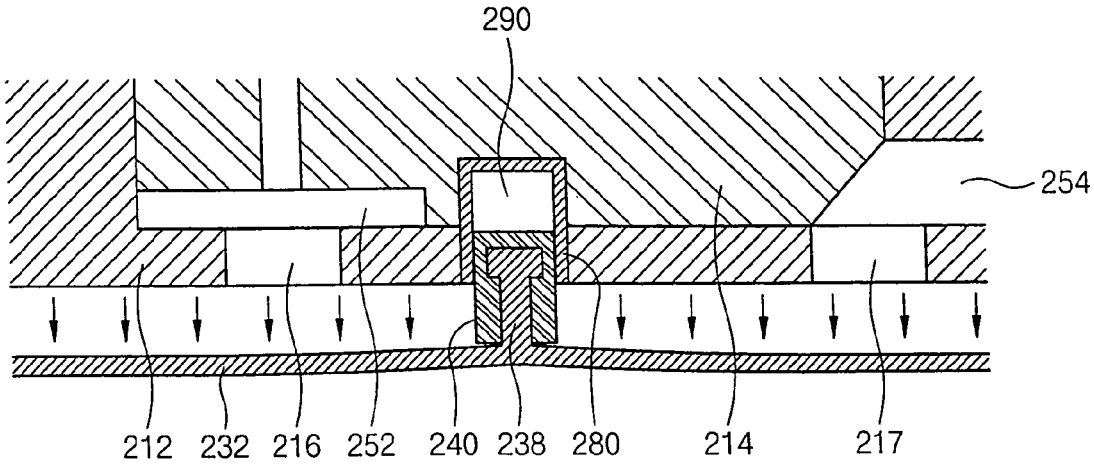
FIG. 7A and FIG. 7B are sectional views of a portion of the polishing head, showing the expanded and contracted states of the membrane, respectively.
Figure 7B:
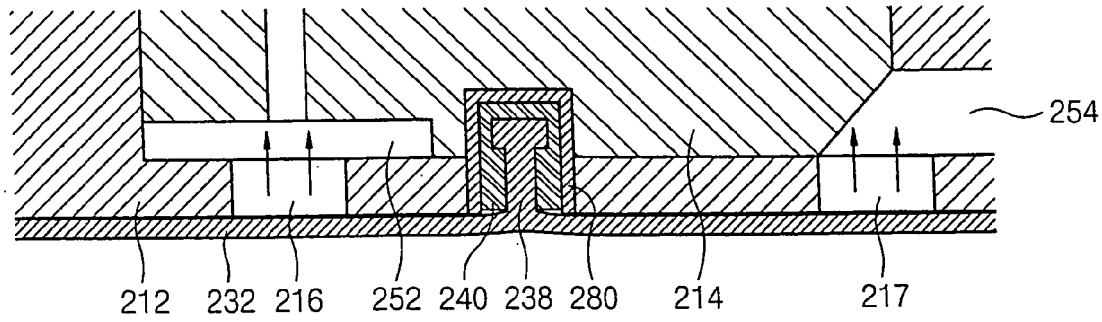

FIG. 7*a* and FIG. 7*b* show, respectively, the states in which the membrane 230 is expanded and contracted. When the membrane 230 is expanded, the slider ring 240 moves downwards within the guide groove 290 whereupon the slider ring 240 protrudes from the guide groove 290. When the membrane 230 is contracted, the slider ring 240 moves upwards within the guide groove 290 until the slider ring 240 is located entirely within the guide groove 290. The slider ring 240 is longer than the distance between the supporting plate 212 and the pressure portion 232 when the membrane 230 is expanded to the greatest extent possible. This ensures that the slider ring 240 will remain within the guide groove 290.

A buffer 280 may be inserted in the guide groove 290 in sliding engagement with the slider ring 240, to enhance the ability of the slider ring 240 to slide smoothly within the guide groove 290. The bushing 280 may be formed by a coating of grease on the inner wall of the membrane supporter 210 that defines the guide groove 290. Alternatively, the buffer 280 may be a Teflon™ member attached to the inner wall of the membrane supporter 210 that defines the guide groove 290. Still further, the buffer 280 may be a coating grease on the outer surface of the slider ring 240 when the slide ring 240 is made of stainless steel.

Figure 8:
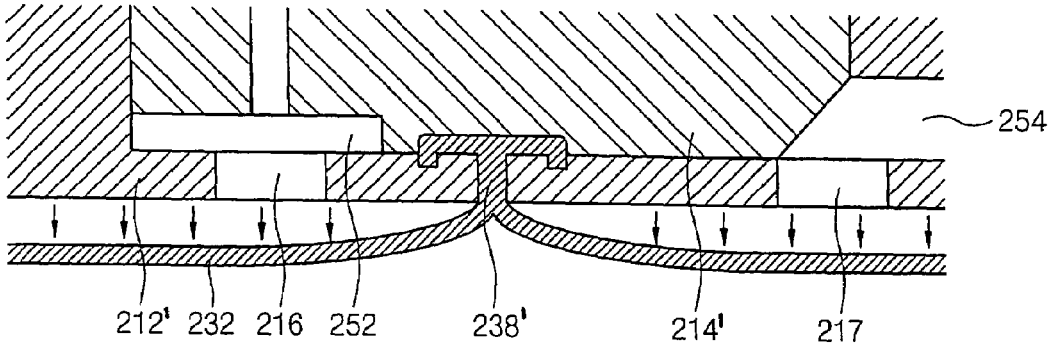
Fig. 8 (PRIOR ART)
FIG. 8 is a sectional view of a portion of a prior art polishing head, showing a partition of the membrane fixed to a membrane supporter.
Figure 9:
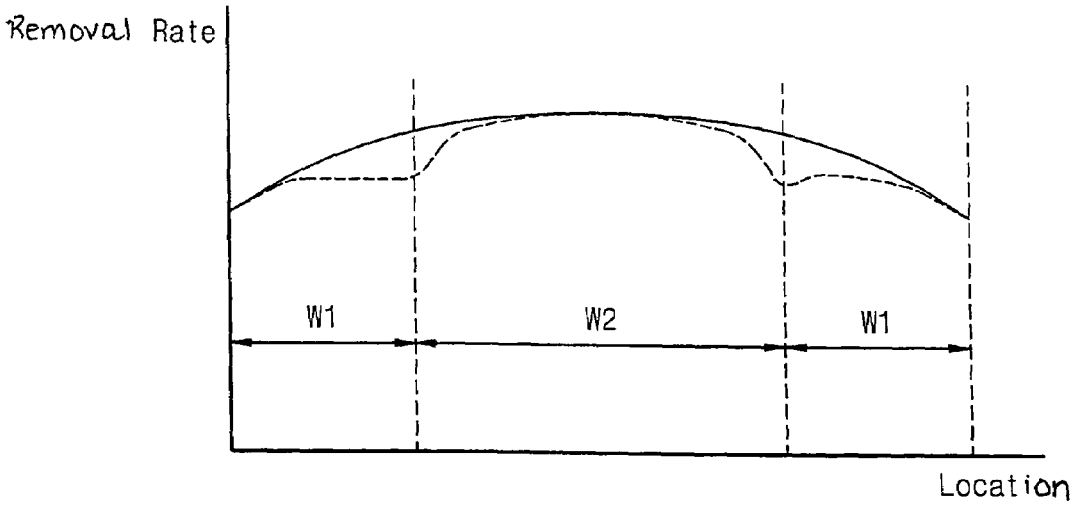
FIG. 9 is a graph showing the relations between regions of a wafer and the removal rate of material when using a typical prior art polishing head and a polishing head of present invention.

As shown in FIG. 8, in the case of the typical prior art polishing head 200', the partition portion 238' of the membrane is directly fixed to the supporting plate 212' and the clamp ring 214'. Thus, a substantial concavity is formed in the membrane, at a location corresponding to the fixed partition portion 238', when the membrane is expanded. Accordingly, as shown by the dashed line in FIG. 9, the rate at which material is removed during the polishing process exhibits a marked decrease at a location between the central and peripheral portions of the wafer, corresponding to the location where the partition portion 238' of the membrane is fixed.

On the other hand, the partition portion 238 and the slider ring 240 of the present invention move downward with the pressure portion 232 of the membrane 230 when the membrane 230 is expanded. Accordingly, the pressure portion 232 of the membrane 230 exhibits a gentle curvature over the entire surface thereof when the membrane is expanded. Therefore, the remove rate is characterized by a gentle curve, as shown by the solid line in FIG. 9, meaning that the pressure exerted on each region W1, W2 of the wafer and hence, the removal rate across each region W1, W2 is much more uniform than compared to the prior art.

Finally, although the present invention has been described above in connection with the preferred embodiments thereof, various changes to and modifications of the preferred embodiments will be readily apparent to those of ordinary skill in the art. For example, although the membrane has been described as being divided into two regions and the polishing head as having one corresponding slider ring, the membrane may be divided into more than two regions and the polishing head may thus have a number of slider rings corresponding to the regions of the membrane. Accordingly, all such changes and modifications that come with in the scope of the appended claims are seen to be within the true spirit of the invention.

What is claimed is:

1. A polishing head of a chemical mechanical polishing apparatus, comprising:

a membrane supporter, said membrane supporter having a guide groove;

a membrane having a fixing portion fixed to said membrane supporter, a pressure portion including a plurality of regions, and a partition portion extending from said pressure portion at a border between said plurality of regions;

a slider to which said partition portion of the membrane is fixed, said slider being received in said guide groove in the membrane supporter and being slidable relative to said membrane supporter within said guide groove between a first position at which said membrane is expanded, and a second position at which said membrane is contracted; and, a first air chamber open to one of said plurality of regions of the pressure portion of said membrane at an outer peripheral portion of the membrane located to one side of said partition portion and a second air chamber open to another one of said plurality of regions of the pressure portion of said membrane located to the other side of said partition member, whereby different amounts of air pressure can be exerted on said plurality of regions of the pressure portion of said membrane via said first and second air chambers, respectively.

2. The polishing head of claim 1, wherein said slider is disposed entirely within said guide groove when in said second position at which the membrane is contracted.

3. The polishing head of claim 1, and further comprising a buffer interposed between said slider and an inner wall of said membrane supporter that defines the guide groove, and contacting said slider.

4. The polishing head of claim 3, wherein said buffer is a member formed from a tetrafluoroethylene fluorocarbon compound and disposed in siding engagement with said slider.

5. The polishing head of claim 1, wherein said slider has a groove in which said partition portion of the membrane is received, said groove having a lower portion and an upper portion extending from the lower portion, the upper portion of said groove having a cross section that is wider than that of the lower portion of said groove, and said partition portion of the membrane having complimentary first and second parts received in the lower portion and upper portions of the groove in said slider, respectively, whereby the partition portion of the membrane is fixed to said slider.

6. The polishing head of claim 1, wherein said slider has a groove in which said partition portion of the membrane is received, and further comprising at least one fastener securing said partition member to said slider.

7. The polishing head of claim 1, wherein said slider is formed from a tetrafluoroethylene fluorocarbon compound.

8. The polishing head of claim 1, wherein said slider is annular.

9. A chemical mechanical polishing apparatus, comprising:

a platen;

a polishing pad adhered to the platen; and a polishing head assembly disposed above said polishing pad and including a polishing head that urges a substrate against the polishing pad during a chemical mechanical polishing process, said polishing head including a membrane supporter having a guide groove extending vertically therein, a membrane having a fixing portion fixed to said membrane supporter, a pressure portion including a plurality of regions, and a partition portion extending upwardly from said pressure portion at a border between said plurality of regions;

a slider to which said partition portion of the membrane is fixed, said slider being received in said guide groove in the membrane supporter and being slidable vertically relative to said membrane supporter within said guide groove between a first position at which said membrane is expanded, and a second position at which said membrane is contracted; and, a first air chamber open to one of said plurality of regions of the pressure portion of said membrane at an outer peripheral portion of the membrane located to one side of said partition portion, and a second air chamber open to another one of said plurality of regions of the pressure portion of said membrane located to the other side of said partition member, whereby different amounts of air pressure can be exerted on said regions of the pressure portion of said membrane via said first and second air chambers, respectively.

10. The apparatus of claim 9, wherein said slider of the polishing head is disposed entirely within said guide groove when in said second position at which the membrane is contracted.

11. The apparatus of claim 9, wherein said polishing head further comprises a buffer interposed between said slider and an inner wall of said membrane supporter that defines the guide groove, said buffer being disposed in contact with said slider.

12. The apparatus of claim 9, wherein said slider of the polishing head has a groove in which said partition portion of the membrane is received, said groove having a lower portion and an upper portion extending from the lower portion, the upper portion of said groove having a cross section that is wider than that of the lower portion of said groove, and said partition portion of the membrane having complimentary first and second parts received in the lower portion and upper portions of the groove in said slider, respectively, whereby the partition portion of the membrane is fixed to said slider.

13. The apparatus of claim 9, wherein said slider of the polishing head has a groove in which said partition portion of the membrane is received, and further comprising at least one fastener securing said partition member to said slider.

14. A polishing head adapted for use in a chemical mechanical polishing apparatus, comprising:

a membrane supporter, comprising a peripherally located clamp ring, a centrally located gimbal, and a guide groove located between the clamp ring and the gimbal;

a membrane comprising a first portion fixed to the clamp ring, a second portion fixed to the membrane supporter proximate the gimbal, a partition portion, and a pressure portion including a plurality of regions, wherein the membrane further comprises a front surface adapted to receive a wafer and back surface from which the partition portion extends to separate the plurality of regions; and, a slider connected to the guide groove and adapted to slide relative to the membrane support from a first position when the membrane is expanded to a second position when the membrane is contracted and further adapted to fix the partition portion;

wherein the pressure portion is divided into a first pressure region between the first portion and the partition portion, and a second pressure region between the partition portion and the second portion.

15. The polishing head of claim 14, wherein the slider is disposed entirely within the guide groove when the membrane is expanded.

16. The polishing head of claim 14, further comprising a buffer interposed between the slider and an inner wall of the membrane supporter that defines the guide groove.

17. The polishing head of claim 16, wherein the buffer is formed from a tetrafluoroethylene fluorocarbon compound and disposed in siding engagement with the slider.

18. The polishing head of claim 14, wherein the slider has a groove in which the partition portion of the membrane is fixed, the groove having a lower portion and an upper portion extending from the lower portion.

19. The polishing head of claim 14, wherein the slider comprises a groove adapted to receive the partition portion, and further comprising at least one fastener securing the partition portion to the slider.

* * * * *